United States Patent [19]

Bizouard et al.

[11] 3,945,016

[45] Mar. 16, 1976

[54] WIDE-BAND SPIRAL ANTENNA

[75] Inventors: Alain Bizouard; Jean Rannou, both of Paris, France

[73] Assignee: Thomson-CSF, Paris, France

[22] Filed: Aug. 28, 1974

[21] Appl. No.: 501,201

[30] Foreign Application Priority Data

Aug. 31, 1973 France ..... 73.31522

[52] U.S. Cl. ..... 343/895; 343/833

[51] Int. Cl.[2] ..... H01Q 1/36

[58] Field of Search ..... 343/845, 833

[56] References Cited

UNITED STATES PATENTS 2,919,442 12/1959 Nussbaum ..... 343/895

3,745,585 7/1973 Barbano ..... 343/895

*Primary Examiner*—Eli Lieberman

*Attorney, Agent, or Firm*—Edwin E. Greigg

[57] ABSTRACT

The invention relates to wide-band, plane, spiral antennas. A conductive arm is arranged spirally in a plane close to a reflector. A resonator member positioned at the centre and in front of the spiral assists the area opposite which it is situated to radiate at high frequencies, to the detriment of the peripheral areas. An absorbent member whose thickness increases from the centre to the periphery increases this effect even further.

8 Claims, 5 Drawing Figures

WIDE-BAND SPIRAL ANTENNA

BACKGROUND OF THE INVENTION

The present invention relates to wide-band antennas of the plane spiral type which have one or two conductive arms arranged spirally in a plane close to a reflector. Such antennas are widely known for their ability to operate with a wide band width. In a given frequency band, they possess a polar diagram having a constant 3dB aperture, a constant gain and a low level of ellipticality. These characteristics are achieved without any great difficulty in a frequency band in which the ratio between the upper frequency and the lower frequency is 3:1. When the ratio greatly exceeds 3:1 two main defects become apparent:

The first defect is due to the presence of the reflector, which in the case of the upper frequencies, needs to be situated at a distance from the spiral which is less than a quarter of the wave-length ($\lambda/4$). This means that for the lower frequencies the distance in question is no more than $\lambda/12$ when the frequency ratio is 3:1 and $\lambda/24$ when it is 6:1. This being so, at low frequencies the radiation resistance is low and efficiency falls, resulting in a loss of gain.

The second defect is due to the fact that only a relatively restricted area of the antenna contributes to its radiation at any given frequency. At low frequencies this area is situated towards the periphery of the antenna. As the frequency increases this radiation area moves nearer the centre of the spiral. In what follows this area will be known as the main radiation area since at high frequencies one or other interference areas appear, first near the periphery of the antenna and then increasingly near the centre as the frequency continues to rise. The relative phases of the currents in the main and interference areas alter rapidly as a function of frequency. The polar diagram is then no longer in the form of a body of revolution about the axis of the antenna but takes on an elliptical cross-section. This results in sudden alterations in the width of the 3dB polar diagram and the axis along which radiation is at a maximum may, in the case of polar diagrams plotted in planes which do not pass through the axis perpendicular to the plane of the antenna, diverge by up to 10 to 15° from its normal position.

Known solutions which enable the effect of radiation from the interference areas to be reduced consist in attenuating the currents along the spiral by the effect of series or parallel losses.

Series losses may be brought about by reducing the width of the conductors towards the end of the spiral, which results in increased losses per unit length in the conductor, or by reducing the pitch of the spiral which results in an increase in the length of the conductors.

Parallel losses are brought about by using a loss-loaded dielectric support for the conductors.

These solutions are not satisfactory in that they involve a loss of gain in the antenna over the whole of the operating band and in particular at the low frequencies where the nearness of the reflector is already having an unfavourable effect.

The solutions proposed in the present application are not subject to these drawbacks.

SUMMARY OF THE INVENTION

In accordance with a feature of the invention, a resonator member is positioned at the centre and in front of the antenna in order to increase, at high frequencies, the radiation from the area opposite which it is situated. This resonator member thus increases radiation from the main area without increasing that from the interference areas, which reduces the relative contribution of these latter to the radiation from the antenna.

Other features will become apparent from the following description which is illustrated by FIGS. 1 to 5 which show embodiments of antennas according to the invention.

In these figures the same numbers have been used to indicate members which are the same.

DESCRIPTION OF THE PREFERRED EMBODIMENTS

Figure 1:
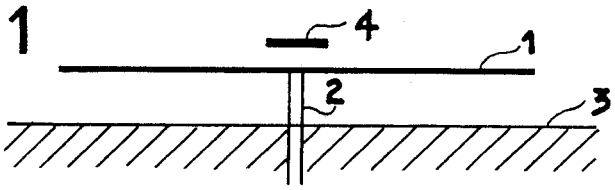
FIG. 1 is a cross-sectional view of a first embodiment of an antenna according to the present invention.

The antenna of FIG. 1 is formed from a double, flat, conductive spiral 1, which is produced for example by photo-etching a flat dielectric substrate; a transmission line 2 which connects the spiral to a transmitter/-receiver (not shown); and a reflector 3.

A director member (resonator member) 4 is placed centrally and in front of the spiral 1.

The effect of this director member 4 is confined to the high frequencies. The main area of radiation is, in effect, situated at the centre of the spiral. The director member 4 is situated opposite this area and does not alter the way in which the antenna operates at low frequencies.

The director member 4 may be formed either by a thin metal disc or by a metal ring. Its diameter is of the order of $\lambda/4$ at the centre frequency of the range over which it is to exert a compensating effect, and it is situated at a distance of the order of $\lambda/10$ in front of the spiral.

By way of illustration, a spiral antenna which operates properly in a frequency band extending from 2.4 to 7 GHz may be used up to 11 GHz by setting up a director member 4 which is calculated for a frequency of 9 GHz (diameter 8mm, situated at 3mm from the spiral 1).

Figure 2:
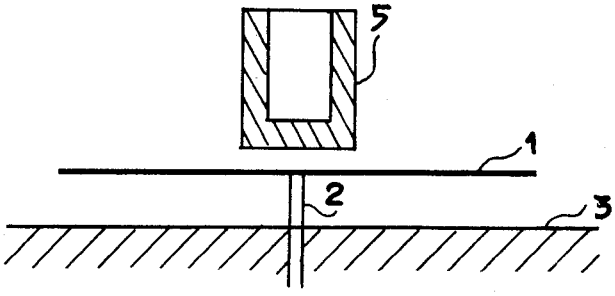
FIG. 2 is a cross-sectional view of a second embodiment of an antenna according to the present invention.

Another technique of enabling the directivity and gain of the antenna to be increased in the main radiation area is illustrated in FIG. 2.

A dielectric resonator 5 is placed centrally and in front of the spiral 1. Its diameter is $D = 0.5\ \lambda/\sqrt{\epsilon-1}$, where $\lambda$ is the wavelength of the centre frequency range in which the compensating function is to be exerted and $\epsilon$ is the dielectric constant of the material employed. The length of the resonator 5 is calculated as a function of the width of the polar diagram at 3dB. For the width in question to be approximately 60° the length needs to be of the order of 0.7 λ. The front face of the resonator 5 is situated at approximately λ/10 from the spiral 1.

Figure 3:
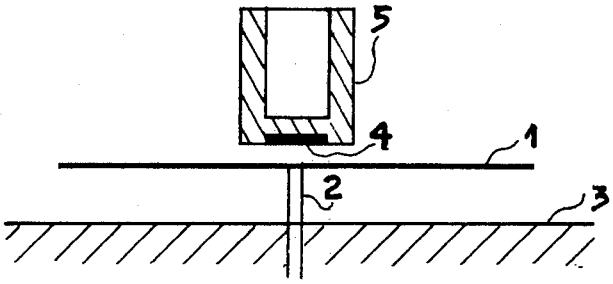
FIG. 3 is a cross-sectional view of a third embodiment of an antenna according to the present invention, incorporating features of the embodiments of FIG. 1 and FIG. 2.

It is possible for the metal disc 4 to be associated with the dielectric resonator. FIG. 3 shows an antenna in which both types of resonator are used. In this case the disc 4 is applied to the front face of the dielectric resonator 5 and its diameter is of the order of $\lambda/4\sqrt{\epsilon}$. By adjusting the relative effect of the two members 4, 5, it is possible to obtain constant widths of polar diagrams as a function of frequency. As an example the width in question may be fixed at between 50° and 70°.

Using these two types of resonator in combination it is possible to obtain a frequency ratio better than 5:1. Operation is unaltered at the lower frequencies in the band and the gain of the antenna is slightly improved at the upper frequencies.

Figure 4:
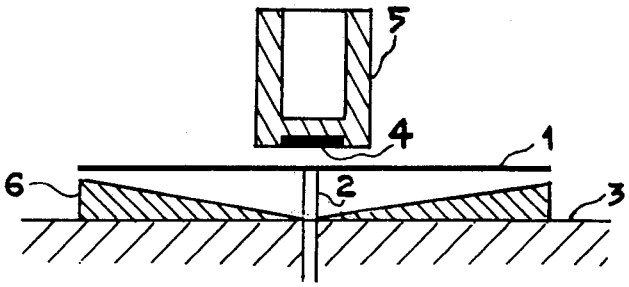
FIG. 4 is a cross-sectional view of a fourth embodiment of an antenna according to the present invention, incorporating an absorber.

The effect of the areas of interference radiation may be even further reduced by using, as is shown in FIG. 4, an absorber 6 the thickness of which changes progressively from the centre outwards.

Where the radiation areas in question are situated, the depth of the absorber 6 is so calculated as to cause the greatest possible reduction in the energy reflected by the reflector 3.

Part of the energy is reflected by the front face of the absorber 6. Another part of the energy passes through the absorber 6, is reflected by the reflector 3 and passes through the absorber 3 for a second time. The thickness of the absorber 6 is equivalent to a quarter of the wavelength. Thus, the energies which are reflected on the one hand from the front face of the absorber 6 and on the other from the reflector 3 are in phase opposition and canel each other out. In the case of the lowest frequencies which give rise to an area of interference radiation, the area in question is situated at the periphery of the spiral. Here the thickness of the absorber 6 is at its maximum. In the case of the higher frequencies the area of interference radiation moves nearer the centre and at the same time the thickness of the absorber must be reduced so that it remains equal to λ/4.

The thickness of the absorber 6 thus varies linearly as a function of distance from the centre.

The absorber 6 may be defined by a body of revolution and is made from a material based on iron dust which attenuates to a degree proportional to frequency and whose impedance and propagation constant are not dependent on frequency. This being so, the effect of the reflector 3 is reduced in the areas of interference radiation. In contrast, there is no alteration in the main radiation area.

Since the absorber affects only the energy reflected by the reflector 3, its effect is limited but extends over a wide band. It may be associated with any of the embodiments above described.

This being so, by associating the two resonators 4, 5 previously described with the absorber 6, as is shown in FIG. 4, a spiral antenna can be made to operate in a frequency band of from one to three octaves.

Figure 5:
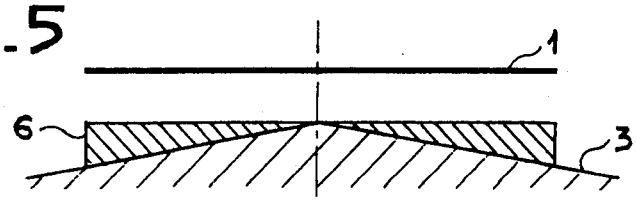
FIG. 5 is a cross-sectional view of a fifth embodiment of an antenna according to the present invention, incorporating a particularly shaped absorber, and having a conical reflector.

FIG. 5 shows a modification of the antenna of FIG. 4 in which the reflector 3 is not plane but conical. In this case the front face of the absorber 6 is plane.

The invention is applicable in particular to wide-band goniometric antennas.

What we claim is:

1. A wide-band spiral antenna comprising a reflector, at least one conductive, spiral arm arranged in a plane near said reflector, and a resonator member positioned centrally and in front of said spiral arm for increasing radiation at high frequencies from an area in front of which said member is situated.

2. A wide-band spiral antenna comprising a reflector, at least one conductive, spiral arm arranged in a plane near said reflector, a resonator member positioned centrally and in front of said spiral arm for increasing radiation at high frequencies from an area in front of which said member is situated, and an absorbent member positioned against and in front of said reflector, the thickness of said absorbent member increasing from the centre of the antenna to its periphery.

3. An antenna according to claim 2, wherein a front face of said absorbent member defines a plane surface and said reflector is formed by a truncated cone the apex angle of which is of predetermined size.

4. An antenna according to claim 2, wherein the said resonator member is a metal disc.

5. An antenna according to claim 2, wherein the said resonator member is a metal ring.

6. An antenna according to claim 2, wherein the said resonator member is a dielectric cylinder.

7. An antenna according to claim 2, wherein the said resonator member is composed of a dielectric cylinder and a metal disc, which is applied to a face of said cylinder which is situated on the same side of said reflector as said spiral arm.

8. An antenna according to claim 2, wherein the said resonator member is composed of a dielectric cylinder and a metal ring which is applied to a face of said cylinder which is situated on the same side of said reflector as said spiral arm.

* * * * *